US005375552A

United States Patent [19]

Scott

[11] Patent Number: 5,375,552

[45] Date of Patent: Dec. 27, 1994

[54] CUSHION FOR REMOVABLE ATTACHMENT TO PLATFORMS OF BOATS OR THE LIKE

[76] Inventor: Walter B. Scott, 1809 E. 7th St., Superior, Wis. 54880

[21] Appl. No.: 34,071

[22] Filed: Mar. 22, 1993

Related U.S. Application Data

[63] Continuation-in-part of Ser. No. 601,030, Oct. 19, 1990, Pat. No. 5,195,763, which is a continuation of Ser. No. 264,995, Oct. 31, 1988, abandoned.

[51] Int. Cl.[5] ..... B63B 17/00

[52] U.S. Cl. ..... 114/363; 297/219.1; 5/470

[58] Field of Search ..... 441/125–128, 441/129, 130; 114/363, 343; 297/DIG. 6, 461, 219.1; 5/470

[56] References Cited

U.S. PATENT DOCUMENTS

| | | | |
|---|---|---|---|
| 351,790 | 11/1886 | Paton | 280/18 |
| 1,104,398 | 7/1914 | Zimmerman | 280/32.6 |
| 2,472,185 | 6/1949 | Apel | 114/363 |
| 2,576,455 | 11/1951 | Gratt | 5/354 |
| 2,596,547 | 5/1952 | Guest | 5/334 |
| 2,614,273 | 10/1952 | Yancofski | 5/354 |
| 2,843,391 | 7/1958 | Pelletier | 280/32.6 |
| 3,065,020 | 11/1962 | Cox | 114/363 X |
| 3,308,490 | 3/1967 | Cacioppo | 5/471 |
| 3,370,818 | 2/1968 | Perr | 114/343 X |
| 3,446,531 | 5/1969 | Froelich | 297/DIG. 6 |
| 3,479,046 | 11/1969 | Thompson | 280/18 |
| 3,982,748 | 9/1976 | Hooper et al. | 280/18 |
| 4,244,594 | 1/1981 | Hines | 280/32.6 |
| 4,260,440 | 4/1981 | Frankenberg | 156/163 |
| 4,266,707 | 5/1981 | Rossman | 114/363 X |
| 4,317,244 | 3/1982 | Balfour-Richie | 5/470 |
| 4,405,142 | 9/1983 | Whetstine | 280/242 WC |
| 4,450,193 | 5/1984 | Staebler | 428/71 |
| 4,549,323 | 10/1985 | Brockhaus | 5/455 |
| 4,624,022 | 11/1986 | Dolan | 5/508 |
| 4,658,452 | 4/1987 | Brockhaus | 5/420 |
| 4,671,568 | 6/1987 | Greer | 297/229 |
| 4,723,300 | 2/1988 | Aranow | 383/4 |
| 4,726,083 | 2/1988 | Hoshall | 297/DIG. 6 X |
| 4,777,681 | 10/1988 | Lück et al. | 5/464 |
| 4,805,244 | 2/1989 | Scott | 2/272 |
| 5,195,763 | 3/1993 | Scott | 280/32.6 |

*Primary Examiner*—Sherman Basinger

*Attorney, Agent, or Firm*—Peterson, Wicks, Nemer & Kamrath

[57] ABSTRACT

A cushion for removable attachment to horizontal, rigid thwarts of boats or the like is disclosed according to the preferred teachings of the present invention including a flexible insulator removably received within a flexible bag-like covering. The insulator in its preferred form includes first and second reflective layers sandwiching sealed, multiple air cell material. The reflective layers reflect body heat back and cold away from the user. The air encapsulated in the air cells acts as insulation in reducing heat transfer and provides a resilient, cushion-type support. The cushion has a size and shape generally equal to and complementary to the top surface of the platform and is removably held thereon by fasteners which in the preferred form are VELCRO ® fasteners secured to the bottom surface of the covering and the top surface of the platform such as by double-sided adhesive tape whereby the insulator is located intermediate the platform and the user sitting, laying or otherwise supported thereon. Thus, the cushion may be secured to and removed from the platform without the use of tools and without modification to the platform.

20 Claims, 1 Drawing Sheet

CUSHION FOR REMOVABLE ATTACHMENT TO PLATFORMS OF BOATS OR THE LIKE

CROSS REFERENCE

The present application is a continuation-in-part of pending application Ser. No. 07/601,030 filed Oct. 19, 1990, now U.S. Pat. No. 5,195,763 which is a continuation of application Ser. No. 07/264,995 filed Oct. 31, 1988, now abandoned.

BACKGROUND

The present invention generally relates to cushions for removable attachment to rigid platforms, particularly to removably attachable cushions for horizontal platforms, and in the most preferred form to removably attachable cushions for platforms of a boat or the like.

Boats include thwarts which extend transversely across the hull and spreading the gunwales of the boat which act as a seat or platform for the fisherman or other user of the boat. Such thwarts are generally planar, rigid, and horizontal and typically are formed of aluminum or wood. Many boats include an enclosure under the thwarts which include flotation material to prevent the boat from completely sinking in the event that the boat should fill with water or should capsize.

During fishing and boating, the user is typically supported on the thwarts by sitting thereon. However, since they are rigid, thwarts are generally uncomfortable especially when sat upon for long periods of time. During long stretches of time when activity level is low (for example, when the fish are not biting), the user will often lay upon the thwarts for support in other positions to reduce the stress of maintaining a sitting position. This is especially a problem where no backrests are provided which is often the case in boats and the user will tend to slouch or hunch his back while sitting for long periods of time. Further, as the user is supported close to the water, the user is subject to cold drafts which are readily conducted through the thwarts especially when formed of aluminum or other metal.

One accessory which is available for boaters and fisherman are flotation devices of a generally square shape and which include loop straps sewn thereto through which the arms of the user can extend therethrough for wearing as a life vest. When not in use as a life vest, such flotation devices are intended to be used as seat cushions for the boat. However, no provision is made for securing the seat cushions to the thwarts so the flotation device typically will slide on the thwarts during movement of the user relative to the thwarts and/or during movement of the boat, thus making their use as a cushion less than desirable, with the flotation device often laying on the bottom of the boat and not being used as a cushion. Additionally, as their intended use is as a life vest, such flotation devices are generally of the size equal to the seat of the user and typically much smaller than that of thwarts of the boat. Thus, in the event that the user wished to lay on the thwart, the flotation device was utilized as a pillow to support the head of the user, with the remaining portions of the user being supported directly on the thwarts.

Although many boats do have cushioned chairs, such chairs are generally installed during manufacture of the boat or as accessories to boats separate from the thwarts of the boat and include no provision for easy removal of the chair and/or the cushioning thereof from the boat.

Thus, a need has arisen for a cushion which is removably attached to existing rigid platforms such as thwarts for boats or the like, which is securable and removable without the use of tools, which is free from projections which would detract from the comfort to the user supported on the platform, and which does not require modifications to the platform to allow securement of the cushion thereto.

SUMMARY

The present invention solves this and other needs and problems in the field of rigid platform cushions by providing a cushion of a size generally equal to and complementary to the platform and including a lower surface which is releasably secured directly to the top surface of the platform without the use of tools or modifications to the platform and which is free of projections which would detract from the comfort to the user when the cushion is intermediate the platform and the user when the user is supported on the platform.

In the preferred form, the cushion is removably secured to the rigid platform by fastener portions such as VELCRO® hook and loop fasteners secured to the cushion and to the top surface of the platform such that the cushion is intermediate the fastener portions and the user supported on the platform.

In the most preferred form, the platform is a thwart extending transversely across the hull and spreading the gunwales of a boat, with the user being supported on the thwart by either sitting or laying upon the cushion releasably secured thereto.

Additionally, in the preferred form, the platform cushion includes a flexible insulator received within a flexible covering. In its most preferred form, the insulator includes first and second reflective layers sandwiching sealed, multiple air cell material. The reflective layers reflect body heat back to the user and cold away from the user. The air encapsulated in the air cells of the material acts as insulation in reducing heat transfer and provides a resilient, cushion-type support for the user.

It is thus an object of the present invention to provide a cushion for removable attachment to a rigid platform.

It is further an object of the present invention to provide such a novel rigid platform cushion which is free from projections from the top surface of the rigid platform.

It is further an object of the present invention to provide such a novel rigid platform cushion which is securable without the use of tools.

It is further an object of the present invention to provide such a novel rigid platform cushion which is securable to existing platforms without modification.

It is further an object of the present invention to provide such a novel rigid platform cushion which does not require factory installation.

It is further an object of the present invention to provide such a novel rigid platform cushion which stops chills from entering the area of the back, buttocks, and upper legs of a user.

It is further an object of the present invention to provide such a novel rigid platform cushion which reflects and retains body warmth.

It is further an object of the present invention to provide such a novel rigid platform cushion which is thin.

It is further an object of the present invention to provide such a novel rigid platform cushion which is flexible.

It is further an object of the present invention to provide such a novel rigid platform cushion which is comfortable.

It is further an object of the present invention to provide such a novel rigid platform cushion which does not detract from the comfort and aesthetic appearance to the user.

It is further an object of the present invention to provide such a novel rigid platform cushion which provides a cushion-type support.

It is further an object of the present invention to provide such a novel rigid platform cushion which is moisture proof.

It is further an object of the present invention to provide such a novel rigid platform cushion which reflects cold away from the user.

It is further an object of the present invention to provide such a novel rigid platform cushion which is not prone to being pulled from the rigid platform by the movement of the user.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
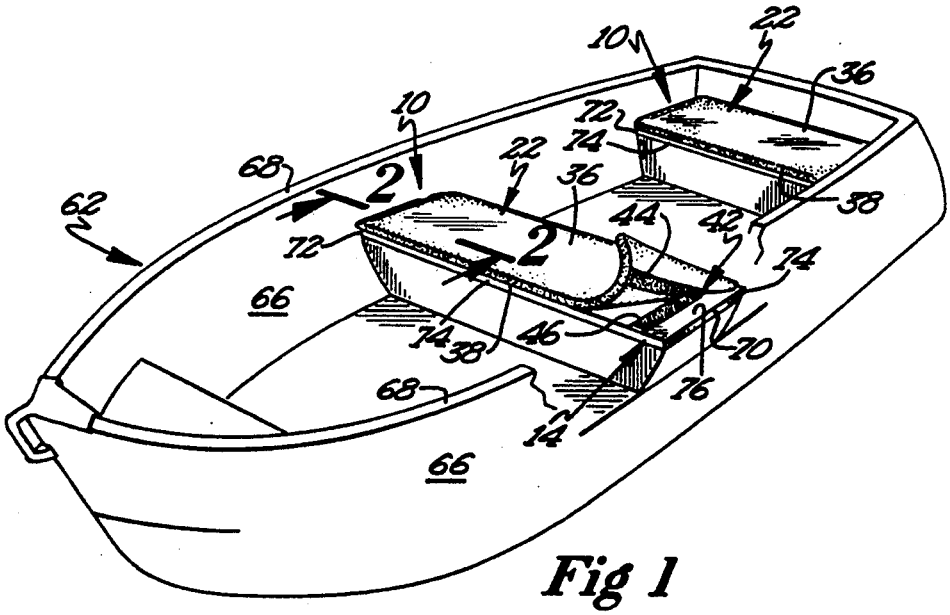
FIG. 1 shows an exploded perspective view of a rigid platform cushion according to the preferred teachings of the present invention, with portions being broken away.
Figure 2:
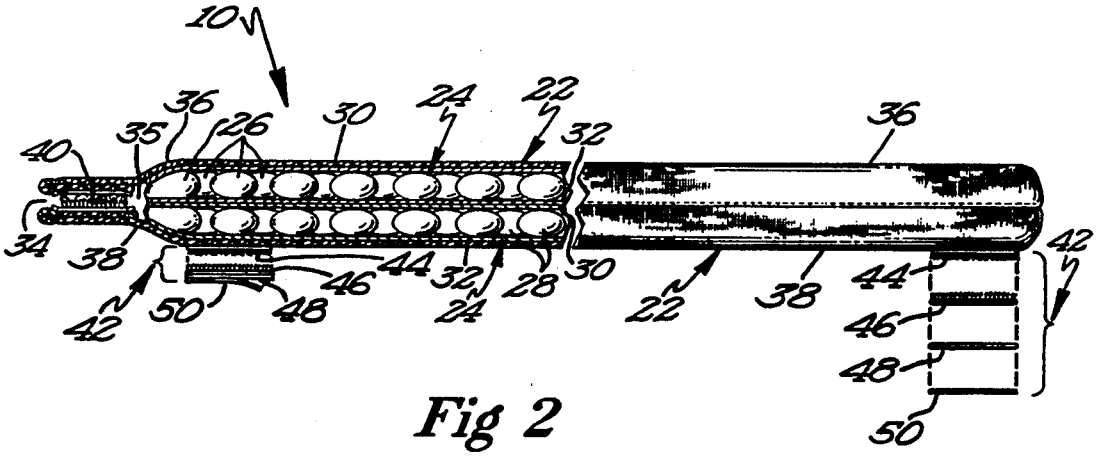
FIG. 2 shows a cross-sectional view of the rigid platform cushion of FIG. 1 according to section line 2—2 of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "inner", "outer", "interior", and similar terms are used herein, it should be understood that these terms have reference only to the structure shown in the drawings as it would appear to a person viewing the drawings and are utilized only to facilitate describing the invention.

DESCRIPTION

A cushion for removable attachment to existing, rigid, horizontal thwarts of a boat or the like according to the preferred teachings of the present invention is shown in the drawings and is generally designated 10. Boat 62 generally includes first and second sides or bulwarks 66, with the thwarts 14 extending transversely across the hull and spreading the gunwales 68 or upper ends of bulwarks 66. In the preferred form, thwarts 14 act as a seat or platform for supporting the fisherman or other boat user thereon, with the user being supported on platform 14 generally either by sitting or laying thereon. Particularly, platform 14 has a top end 70 located at the port bulwark 66, a bottom end 72 located at the starboard bulwark 66, and first and second sides 74 around a top surface 76.

Cushion 10 includes a flexible covering 22 and a laminated insulator 24. Insulator 24 is thin, soft, lightweight, flexible, cushiony, heat reflective, and moisture proof. Specifically, in the preferred form of the present invention, insulator 24 is formed of layers 26 and 28 of sealed, multiple air cell material sandwiched between first and second metalized plastic sheet or metallic foil or other reflective member or layers 30 and 32. It can then be appreciated that layers 26 and 28 are formed of plastic material and as such do not absorb or hold water. Similarly, layers 30 and 32 do not absorb or hold water. It can further be appreciated that the air encapsulated in layers 26 and 28 acts as an insulator in reducing heat transfer. Similarly, layers 26 and 28 provide a resilient, cushion-type support as the encapsuled air within layers 26 and 28 can be compressed to act in the manner of a shock absorber and spring. In the most preferred form, insulator 24 is one-fourth of an inch (0.64 cm) thick. In the preferred embodiment, two insulators 24 are utilized in an abutting relation in each cushion 10.

Flexible covering 22 is a bag-like component having an open top 34 for receipt of and enclosing insulator 24. Generally, covering 22 includes two halves 36 and 38 having a shape and size corresponding to but slightly larger than insulator 24. Halves 36 and 38 are joined by their side and bottom peripheries such as by stitching. Suitable provisions 40 such as VELCRO® hook and loop type fasteners may be provided for releasably closing open top 34 to allow removable placement of insulator 24 within interior 35 of covering 22.

In its most preferred form, covering 22 may be formed of flexible material such as fabric or vinyl which can be stain and wear resistant, spark and flame resistant, non-static, washable, and comfortable to the touch of the skin of the user.

Cushion 10 according to the teachings of the present invention has a shape corresponding to top surface 76 of platform 14 and specifically to platform 14 between sides 74 and between top and bottom ends 70 and 72 of platform 14. In the most preferred form, cushion 10 has an elongated length between ends 70 and 72 which is substantially larger than its width between sides 74 and than the width of the buttocks of the user and specifically would allow multiple users to be seated upon cushion 10 or for a single user to lay upon cushion 10. In its most preferred form, cushion 10 is 48 inches (122 cm) long and 11½ inches (29 cm) wide. According to the teachings of the present invention, cushion 10 includes provisions 42 for releasably securing covering 22 to platform 14 to allow easy removal without the use of tools. Specifically, in its most preferred form; provision 42 is VELCRO® hook and loop-type fasteners and generally includes a first portion 44 which may be either the hook or loop fastener portion and a second portion 46 which may be the other of the hook or loop fastener portion and which is removably interconnectable to portion 44. In its most preferred form, portion 44 is permanently secured to half 38 of covering 22 forming the lower surface of cushion 10 such as by adhesive or sewing. Suitable provision 48 is further provided to permanently secure portion 46 to top surface 76 of platform 14 of an existing boat 62 such as double-sided adhesive tape having a first side adhered to portion 46 and a second side covered by a removable protective covering sheet 50. Thus, after sheet 50 has been removed from tape 48, the second side of tape 48 can be adhered to top surface 76 of platform 14. In its most preferred form, two provisions 42 are provided extending laterally between sides 74 and generally parallel to and adjacent but spaced from top and bottom ends 70 and 72 of platform 14. Thus, provisions 42 releasably secure cushion 10 to top surface 76 of platform 14. Cushion 10 has a thickness generally equal to the thickness of insulator 24, as the thickness of halves 36 and 38 is relatively small, and specifically has a thickness in the range of 5/8 inch (1.59 cm). Cushion 10 according to the teachings of the present invention is lightweight.

Now that the construction of cushion 10 according to the teachings of the present invention has been explained, the preferred uses and advantages of cushion 10 can be set forth and appreciated. Specifically, due to its thinness, cushion 10 may be positioned on platform 14 on existing boats 62 between sides 74 without bulkiness in a manner as shown in the drawings such that the user may sit or lay thereon and without a significant increase in the overall height of platform 14. Particularly, cushion 10 according to the teachings of the present invention may be marketed separately from boat 62 and can be applied to existing platforms 14 of boats 62 without modification thereto. Cushion 10 is not required to be assembled to boat 62 during its manufacture and does not require modifications to present platforms 14 and/or boats 62 as bolts or the like extending through yolks or the like are not utilized.

It should then be appreciated that provisions 40 and 42 are advantageous. Specifically, provisions 40 and 42 are flat, flexible, soft, and thin such that they do not provide raised projections or obstructions from platform 14 when cushion 10 is removably secured to top surface 76 thereof. Further, as insulator 24 is located intermediate provisions 42 and 48 and the user supported on platform 14, insulator 24 acts as a buffer to the limited increase in thickness resulting from provisions 42 and 48. Similarly, it can be appreciated that provisions 42 and 48 are located intermediate the top surface of platform 14 of boat 62 and half 38 of covering 22 and thus do not extend over or from the periphery or half 36 of covering 22 and ends 70 and 72 and sides 74 of boat 62 in its most preferred form. It can then be appreciated that snaps, yoke members, bolts and other attachment devices would provide raised projections from platform 14 which would detract from the comfort when the user is seated, laying or otherwise supported thereon and from the overall appearance of boat 62. Further, cushion 10 can be easily removed from boat 62 without the use of tools simply by pulling on cushion 10 separating portions 44 and 46. It can then be appreciated that due to the minimal presence of cushion 12 remaining, i.e. tape 48 and second portion 46 according to the teachings of the present invention, boat 62 may be utilized with cushion 10 removed with minimal change in comfort, appearance and the like as boat 62 prior to utilization of cushion 10 according to the teachings of the present invention.

According to the teachings of the present invention, layer 30 reflects the user's body heat back to the user and similarly, layer 32 reflects away the cold from platform 14 of boat 62 or the like. This feature maximizes the use of the user's body heat in keeping warm. Further, with layers 26 and 28 of insulator 24, this feature also reduces the loss of the user's body heat such that the user's body heat is retained.

Covering 22 according to the teachings of the present invention adds comfort to the user as it covers insulator 24 and specifically layer 30 thereof such that layer 30 does not directly engage the user's skin and clothing as layers 30 and 32 of insulator 24 may be abrasive to the user's skin and outer garments. Further, covering 22 can absorb any perspiration of the user and keeps insulator 24 from sticking to the user's skin from such perspiration to provide added comfort. Additionally, due to the releasably closable nature of open top 34, covering 22 may be cleaned after insulator 24 is removed from interior 35 thereof.

Cushion 10 according to the teachings of the present invention protects the back, buttocks, and legs of the user supported thereon by sitting or laying thereon from cold objects, winds and dampness and to thus keep these parts of the body warm, dry, and comfortable. Thus, cold chills are stopped from entering the user's back, buttocks, and legs to avoid painful, sore, aching muscles induced by cold chills. This is especially important because the boat user is adjacent to water. Further, due to its lightweight, thin, and flexible nature, cushion 10 according to the teachings of the present invention may be comfortably utilized without restricting body movement. It can then be appreciated that cushion 10 according to the teachings of the present invention provides a synergistic combination for solving the problems associated with cold, damp, and/or windy conditions and/or associated with sitting and/or laying on the relatively hard surface of platform 14 of boat 62.

To extend the life of cushion 10, cushion 10 can be removed from boat 62 to reduce its exposure to the elements. When not attached to platform 14 of boat 62, cushion 10 can be easily stored in a flat condition or, due to its flexible nature, in either a folded or rolled condition or the like. Alternately, cushion 10 can be utilized with other platforms. For example, many docks to which boats 62 are moored when not in use include dock benches which are typically formed of wood planks or the like and which are very rigid. According to the preferred teachings of the present invention, the platforms of such dock benches can include second portions 46 secured thereto such as by tape 48 in locations corresponding to and for removable securement to portions 44 of covering 22 of cushion 10. Thus, when not in use with boat 62, cushion 10 can be removably secured directly to the dock bench without the use of tools or modification to the platform, with cushion 10 being intermediate the user and the dock bench when the user is sitting, laying, or otherwise supported upon the dock bench and with provisions 42 being free of projections which would detract from the comfort to the user supported on the dock bench and upon cushion 10.

Although in the most preferred form of the present invention cushion 10 has been shown and described for releasable securement to thwarts 14 of boat 62, the teachings of the present invention may have application to other forms and types of existing, rigid platforms such as dock benches, picnic table benches, or similar benches, bleachers, or the like where releasable securement to such platforms is desired without the use of tools or modification to the platform and where other types of securement are not available. In this regard, U.S. Pat. No. 5,195,763 shows cushion 10 removably secured to platform 14 of a creeper.

Likewise, although in the most preferred form two air cell material insulators 24 are utilized, one or both layers of insulators 24 could be formed of other materials such as low density expanded ethylene-vinyl acetate copolymers such as sold under the trademark EVA-LITE by Monarch Rubber Co. In the most preferred form, one layer of each is provided with the air cell material being located intermediate platform 14 and the other layer of expanded copolymer material, which is white in the preferred form to reflect rather than absorb heat. Such an arrangement creates a space from the reflective layers 30 and 32 to enhance the heat reflection thereby and enhances the elasticity of the air cell material.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. For use with a rigid platform having a top end, a bottom end, and first and second sides around a top surface, with the top surface being rigid and hard, with the top surface and at least one of the sides of the rigid platform being free of protuberances allowing the user to be supported on the rigid and hard top surface of the rigid platform, the improvement comprising a cushion of a size generally equal to and complementary to the rigid and hard top surface of the rigid platform, with the cushion including an upper surface and a lower surface, with the user being supported on the upper surface of the cushion and the lower surface being on the opposite side of the cushion than the upper surface, with the cushion being free of protuberances extending beyond the lower surface in a direction opposite to the top surface; and means for releasably securing the lower surface of the cushion directly to the rigid and hard top surface of the rigid platform without the use of tools or modification to the rigid platform, with the cushion being intermediate the user and the rigid platform when the user is supported upon the rigid platform and with the releasably securing means being free of projections which would detract from the comfort to the user supported on the rigid platform and upon the cushion.

2. The improvement of claim 1 wherein the cushion is flexible and comprises, in combination: a flexible insulator received within a flexible covering; and wherein the releasably securing means comprises means for releasably securing the flexible covering to the top surface of the rigid platform.

3. The improvement of claim 2 wherein the insulator comprises, in combination: at least a first layer of sealed, multiple air cell material, with the air encapsulated in the air cells of the material acting as insulation in reducing heat transfer and providing a resilient, cushion type support; and at least a first reflective layer intermediate the air cell material and the user for reflecting the body heat of the user back to the user.

4. The improvement of claim 3 wherein the insulator further comprises, in combination: a second reflective layer, with the first and second reflective layers sandwiching the layer of sealed, multiple air cell material, with the second reflective layer reflecting cold away from the layer of sealed, multiple air cell material and the user.

5. The improvement of claim 4 wherein the covering comprises, in combination: a first half having a side periphery, a bottom periphery, and a top periphery; and a second half having a side periphery, a bottom periphery, and a top periphery, with the first and second halves being joined by their side and bottom peripheries to form a bag-like component defining an interior, with the insulator located within the interior of the bag-like component.

6. The improvement of claim 5 wherein the covering further comprises, in combination: means located adjacent the top peripheries of the first and second halves for removably securing the top periphery of the first half to the top periphery of the second half allowing attachment and detachment of the top peripheries of the halves together without the use of tools for the removable placement of the insulator within the interior of the bag-like component.

7. The improvement of claim 6 wherein the releasably securing means comprises a first fastener portion secured to the second half of the covering, with the lower surface of the cushion located on the second half of the covering; and a second fastener portion directly secured to the top surface of the rigid platform for removable interconnection to the first fastener portion, with the first and second fastener portions being flat and thin.

8. The improvement of claim 7 wherein the second fastener portion is secured to the rigid platform by double-sided adhesive tape having a first adhesive side secured to the second fastener portion and a second adhesive side covered by a removable protective covering sheet and for securing to the top surface of the rigid platform.

9. The improvement of claim 8 wherein the first and second fastener portions comprise hook and loop-type fasteners.

10. The improvement of claim 2 wherein the insulator is moisture proof and will not absorb moisture.

11. The improvement of claim 2 wherein the releasably securing means comprises a first fastener portion secured to the covering, with the lower surface of the cushion located on the covering; and a second fastener portion directly secured to the top surface of the rigid platform for removable interconnection to the first fastener portion, with the first and second fastener portions being flat and thin.

12. The improvement of claim 11 wherein the second fastener portion is secured to the rigid platform by double-sided adhesive tape having a first adhesive side secured to the second fastener portion and a second adhesive side covered by a removable protective covering sheet and for securing to the top surface of the rigid platform.

13. The improvement of claim 12 wherein the first and second fastener portions comprise hook and loop-type fasteners.

14. The improvement of claim 2 wherein the covering comprises, in combination: a first half having a side periphery, a bottom periphery, and a top periphery; and a second half having a side periphery, a bottom periphery, and a top periphery, with the first and second halves being joined by their side and bottom peripheries to form a bag-like component defining an interior, with the insulator located within the interior of the bag-like component.

15. The improvement of claim 14 wherein the covering further comprises, in combination: means located adjacent the top peripheries of the first and second halves for removably securing the top periphery of the first half to the top periphery of the second half allowing attachment and detachment of the top peripheries of the halves together without the use of tools for the removable placement of the insulator within the interior of the bag-like component.

16. The improvement of claim 1 wherein the releasably securing means comprises a first fastener portion secured to the lower surface of the cushion; and a second fastener portion directly secured to the top surface of the rigid platform for removable interconnection to the first fastener portion, with the first and second fastener portions being flat and thin.

17. The improvement of claim 16 wherein the second fastener portion is secured to the rigid platform by double-sided adhesive tape having a first adhesive side secured to the second fastener portion and a second adhesive side covered by a removable protective covering sheet and for securing to the top surface of the rigid platform.

18. The improvement of claim 1 wherein the rigid platform allows the user to sit on the rigid and hard top surface of the rigid platform.

19. The improvement of claim 1 wherein the rigid platform comprises a thwart extending transversely across the hull of a boat and spreading the gunwales of the boat.

20. The improvement of claim 19 wherein both of the sides of the rigid platform are free of protuberances.

* * * * *